US007611217B2

(12) United States Patent
Shamoun et al.

(10) Patent No.: US 7,611,217 B2
(45) Date of Patent: Nov. 3, 2009

(54) METHODS AND SYSTEMS FOR INKJET DROP POSITIONING

(75) Inventors: Bassam Shamoun, Fremont, CA (US); Janusz Jozwiak, San Ramon, CA (US); Eugene Mirro, San Leandro, CA (US); Quanyuan Shang, Saratoga, CA (US); Shinichi Kurita, San Jose, CA (US); John M. White, Hayward, CA (US)

(73) Assignee: Applied Materials, Inc., Santa Clara, CA (US)

( * ) Notice: Subject to any disclaimer, the term of this patent is extended or adjusted under 35 U.S.C. 154(b) by 474 days.

(21) Appl. No.: 11/238,636

(22) Filed: Sep. 29, 2005

(65) Prior Publication Data

US 2007/0070107 A1 Mar. 29, 2007

(51) Int. Cl.
*B41J 29/38* (2006.01)

(52) U.S. Cl. ..... 347/14; 347/19; 347/105

(58) Field of Classification Search ..... 347/14, 347/15, 19, 105
See application file for complete search history.

(56) References Cited

U.S. PATENT DOCUMENTS

| | | | |
|---|---|---|---|
| 4,365,255 | A | 12/1982 | Horike et al. |
| 4,521,786 | A | 6/1985 | Bain |
| 4,571,601 | A | 2/1986 | Teshima |
| 4,987,043 | A | 1/1991 | Roosen et al. |
| 5,114,760 | A | 5/1992 | Takemura et al. |
| 5,177,627 | A | 1/1993 | Ishiwata et al. |
| 5,232,634 | A | 8/1993 | Sawada et al. |
| 5,232,781 | A | 8/1993 | Takemura et al. |
| 5,264,952 | A | 11/1993 | Fukutani et al. |
| 5,340,619 | A | 8/1994 | Chen et al. |
| 5,399,450 | A | 3/1995 | Matsushima et al. |
| 5,432,538 | A | 7/1995 | Carlotta |
| 5,552,192 | A | 9/1996 | Kashiwazaki et al. |
| 5,554,466 | A | 9/1996 | Matsushima et al. |
| 5,593,757 | A | 1/1997 | Kashiwazaki et al. |
| 5,626,994 | A | 5/1997 | Takayanagi et al. |
| 5,648,198 | A | 7/1997 | Shibata |
| 5,702,776 | A | 12/1997 | Hayase et al. |

(Continued)

FOREIGN PATENT DOCUMENTS

| | | | |
|---|---|---|---|
| CN | 1131305 | A | 9/1996 |

(Continued)

OTHER PUBLICATIONS

Office Action of Taiwan Patent Application No. 095135873 (9521-10/TAI) issued on Dec. 10, 2008.

(Continued)

*Primary Examiner*—Thinh H Nguyen
(74) *Attorney, Agent, or Firm*—Dugan & Dugan, PC

(57) ABSTRACT

Methods and apparatus for inkjet inkjet drop positioning are provided. A first method includes determining an intended deposition location of an ink drop on a substrate, depositing the ink drop on the substrate using an inkjet printing system, detecting a deposited location of the deposited ink drop on the substrate, comparing the deposited location to the intended location, determining a difference between the deposited location and the intended location, and compensating for the difference between the deposited location and the intended location by adjusting a parameter of an inkjet printing system. Numerous other aspects are provided.

12 Claims, 7 Drawing Sheets

U.S. PATENT DOCUMENTS

| | | | |
|---|---|---|---|
| 5,705,302 | A | 1/1998 | Ohno et al. |
| 5,714,195 | A | 2/1998 | Shiba et al. |
| 5,716,739 | A | 2/1998 | Kashiwazaki et al. |
| 5,716,740 | A | 2/1998 | Shiba et al. |
| 5,726,724 | A | 3/1998 | Shirota et al. |
| 5,748,266 | A | 5/1998 | Kodate |
| 5,757,387 | A | 5/1998 | Manduley |
| 5,811,209 | A | 9/1998 | Eida et al. |
| 5,817,441 | A | 10/1998 | Iwata et al. |
| 5,831,704 | A | 11/1998 | Yamada et al. |
| 5,847,735 | A | 12/1998 | Betschon |
| 5,880,799 | A | 3/1999 | Inoue et al. |
| 5,895,692 | A | 4/1999 | Shirasaki et al. |
| 5,916,713 | A | 6/1999 | Ochiai et al. |
| 5,916,735 | A | 6/1999 | Nakashima et al. |
| 5,922,401 | A | 7/1999 | Kashiwazaki et al. |
| 5,948,576 | A | 9/1999 | Shirota et al. |
| 5,948,577 | A | 9/1999 | Nakazawa et al. |
| 5,956,063 | A | 9/1999 | Yokoi et al. |
| 5,962,581 | A | 10/1999 | Hayase et al. |
| 5,968,688 | A | 10/1999 | Masuda et al. |
| 5,969,780 | A | 10/1999 | Matsumoto et al. |
| 5,984,470 | A | 11/1999 | Sakino et al. |
| 5,989,757 | A | 11/1999 | Satoi |
| 6,013,415 | A | 1/2000 | Sakurai et al. |
| 6,025,898 | A | 2/2000 | Kashiwazaki et al. |
| 6,025,899 | A | 2/2000 | Fukunaga et al. |
| 6,042,974 | A | 3/2000 | Iwata et al. |
| 6,063,527 | A | 5/2000 | Nishikawa et al. |
| 6,066,357 | A | 5/2000 | Tang et al. |
| 6,071,989 | A | 6/2000 | Sieber et al. |
| 6,078,377 | A | 6/2000 | Tomono et al. |
| 6,087,196 | A | 7/2000 | Sturm et al. |
| 6,106,093 | A | 8/2000 | Nagoshi et al. |
| 6,134,059 | A | 10/2000 | Shirota et al. |
| 6,140,988 | A | 10/2000 | Yamada |
| 6,142,604 | A | 11/2000 | Kanda et al. |
| 6,145,981 | A | 11/2000 | Akahira et al. |
| 6,149,257 | A | 11/2000 | Yanaka et al. |
| 6,153,711 | A | 11/2000 | Towns et al. |
| 6,154,227 | A | 11/2000 | Lund |
| 6,158,858 | A | 12/2000 | Fujiike et al. |
| 6,162,569 | A | 12/2000 | Nakashima et al. |
| 6,196,663 | B1 | 3/2001 | Wetchler et al. |
| 6,211,347 | B1 | 4/2001 | Sieber et al. |
| 6,224,205 | B1 | 5/2001 | Akahira et al. |
| 6,226,067 | B1 | 5/2001 | Nishiguchi et al. |
| 6,228,435 | B1 | 5/2001 | Yoshikawa et al. |
| 6,234,626 | B1 | 5/2001 | Axtell et al. |
| 6,242,139 | B1 | 6/2001 | Hedrick et al. |
| 6,244,702 | B1 | 6/2001 | Sakino et al. |
| 6,264,322 | B1 | 7/2001 | Axtell et al. |
| 6,270,930 | B1 | 8/2001 | Okabe |
| 6,271,902 | B1 | 8/2001 | Ogura et al. |
| 6,277,529 | B1 | 8/2001 | Marumoto et al. |
| 6,281,960 | B1 | 8/2001 | Kishimoto et al. |
| 6,312,771 | B1 | 11/2001 | Kashiwazaki et al. |
| 6,322,936 | B1 | 11/2001 | Nishikawa et al. |
| 6,323,921 | B1 | 11/2001 | Kurauchi et al. |
| 6,331,384 | B1 | 12/2001 | Satoi |
| 6,341,840 | B1 | 1/2002 | van Doorn et al. |
| 6,344,301 | B1 | 2/2002 | Akutsu et al. |
| 6,356,357 | B1 | 3/2002 | Anderson et al. |
| 6,358,602 | B1 | 3/2002 | Horiuchi et al. |
| 6,367,903 | B1 * | 4/2002 | Gast et al. ..... 347/9 |
| 6,367,908 | B1 | 4/2002 | Serra et al. |
| 6,384,528 | B1 | 5/2002 | Friend et al. |
| 6,384,529 | B2 | 5/2002 | Tang et al. |
| 6,386,675 | B2 | 5/2002 | Wilson et al. |
| 6,392,728 | B2 | 5/2002 | Tanaka et al. |
| 6,392,729 | B1 | 5/2002 | Izumi et al. |
| 6,399,257 | B1 | 6/2002 | Shirota et al. |
| 6,417,908 | B2 | 7/2002 | Nishiguchi et al. |
| 6,424,393 | B1 | 7/2002 | Hirata et al. |
| 6,424,397 | B1 | 7/2002 | Kuo |
| 6,426,166 | B2 | 7/2002 | Nishikawa et al. |
| 6,428,135 | B1 | 8/2002 | Lubinsky et al. |
| 6,428,151 | B1 | 8/2002 | Yi et al. |
| 6,429,601 | B1 | 8/2002 | Friend et al. |
| 6,429,916 | B1 | 8/2002 | Nakata et al. |
| 6,433,852 | B1 | 8/2002 | Sonoda et al. |
| 6,450,635 | B1 | 9/2002 | Okabe et al. |
| 6,455,208 | B1 | 9/2002 | Yamashiki et al. |
| 6,462,798 | B1 | 10/2002 | Kim et al. |
| 6,464,329 | B1 | 10/2002 | Koitabashi et al. |
| 6,464,331 | B1 | 10/2002 | Van Doorn et al. |
| 6,468,702 | B1 | 10/2002 | Yi et al. |
| 6,471,352 | B2 | 10/2002 | Akahira |
| 6,475,271 | B2 | 11/2002 | Lin |
| 6,476,888 | B2 | 11/2002 | Yamanashi |
| 6,480,253 | B1 | 11/2002 | Shigeta et al. |
| 6,498,049 | B1 | 12/2002 | Friend et al. |
| 6,508,533 | B2 | 1/2003 | Tsujimoto et al. |
| 6,517,175 | B2 * | 2/2003 | Kanaya et al. ..... 347/7 |
| 6,518,700 | B1 | 2/2003 | Friend et al. |
| 6,557,984 | B2 | 5/2003 | Tanaka et al. |
| 6,569,706 | B2 | 5/2003 | Pakbaz et al. |
| 6,580,212 | B2 | 6/2003 | Friend |
| 6,627,364 | B2 | 9/2003 | Kiguchi et al. |
| 6,630,274 | B1 | 10/2003 | Kiguchi et al. |
| 6,667,795 | B2 | 12/2003 | Shigemura |
| 6,686,104 | B1 | 2/2004 | Shiba et al. |
| 6,692,983 | B1 | 2/2004 | Chen et al. |
| 6,693,611 | B1 | 2/2004 | Burroughes |
| 6,695,905 | B2 | 2/2004 | Rozumek et al. |
| 6,698,866 | B2 | 3/2004 | Ward et al. |
| 6,705,694 | B1 | 3/2004 | Barbour et al. |
| 6,738,113 | B2 | 5/2004 | Yu et al. |
| 6,752,483 | B1 | 6/2004 | Vega et al. |
| 6,762,234 | B2 | 7/2004 | Grizzi |
| 6,897,466 | B2 | 5/2005 | Teramae et al. |
| 7,413,272 | B2 | 5/2006 | Shamoun et al. |
| 7,271,824 | B2 | 9/2007 | Omori et al. |
| 7,377,609 | B2 * | 5/2008 | Walmsley et al. ..... 347/14 |
| 2001/0012596 | A1 | 8/2001 | Kunimoto et al. |
| 2002/0054197 | A1 | 5/2002 | Okada et al. |
| 2002/0081376 | A1 | 6/2002 | Yonehara |
| 2002/0128515 | A1 | 9/2002 | Ishida et al. |
| 2002/0144422 | A1 | 10/2002 | Suhara et al. |
| 2002/0159070 | A1 | 10/2002 | Maeda et al. |
| 2003/0025446 | A1 | 2/2003 | Lin et al. |
| 2003/0030715 | A1 | 2/2003 | Cheng et al. |
| 2003/0039803 | A1 | 2/2003 | Burroughes |
| 2003/0076454 | A1 | 4/2003 | Burroughes |
| 2003/0117455 | A1 | 6/2003 | Bruch et al. |
| 2003/0118921 | A1 | 6/2003 | Chen et al. |
| 2003/0171059 | A1 | 9/2003 | Kawase et al. |
| 2003/0189604 | A1 | 10/2003 | Bae et al. |
| 2003/0189606 | A1 | 10/2003 | Moon et al. |
| 2003/0202029 | A1 | 10/2003 | Bronswijk et al. |
| 2003/0218645 | A1 | 11/2003 | Dings et al. |
| 2003/0222927 | A1 | 12/2003 | Koyama |
| 2003/0224621 | A1 | 12/2003 | Ostergard et al. |
| 2004/0008243 | A1 | 1/2004 | Sekiya |
| 2004/0018305 | A1 | 1/2004 | Pagano et al. |
| 2004/0023567 | A1 | 2/2004 | Koyama et al. |
| 2004/0041155 | A1 | 3/2004 | Grzzi et al. |
| 2004/0075383 | A1 | 4/2004 | Endo et al. |
| 2004/0075789 | A1 | 4/2004 | Wang |
| 2004/0086631 | A1 | 5/2004 | Han et al. |
| 2004/0094768 | A1 | 5/2004 | Yu et al. |
| 2004/0097101 | A1 | 5/2004 | Kwong et al. |
| 2004/0097699 | A1 | 5/2004 | Holmes et al. |
| 2004/0109051 | A1 | 6/2004 | Bright et al. |

| | | | |
|---|---|---|---|
| 2004/0125181 | A1 | 7/2004 | Nakamura |
| 2004/0218002 | A1 | 11/2004 | Nakamura |
| 2005/0041073 | A1 | 2/2005 | Fontaine et al. |
| 2005/0052488 | A1 | 3/2005 | Inoue |
| 2005/0057599 | A1 | 3/2005 | Takenaka et al. |
| 2005/0083364 | A1 | 4/2005 | Billow |
| 2005/0253890 | A1 | 11/2005 | Nagashima |
| 2006/0071957 | A1 | 4/2006 | Shang et al. |
| 2006/0092199 | A1 | 5/2006 | White et al. |
| 2006/0092204 | A1 | 5/2006 | White et al. |
| 2006/0092218 | A1 | 5/2006 | White et al. |
| 2006/0092436 | A1 | 5/2006 | White et al. |
| 2006/0109290 | A1 | 5/2006 | Shamoun |
| 2007/0024664 | A1 | 2/2007 | Shang et al. |
| 2007/0070099 | A1 | 3/2007 | Beer et al. |
| 2007/0070109 | A1 | 3/2007 | White et al. |
| 2007/0076040 | A1 | 4/2007 | Shang et al. |

FOREIGN PATENT DOCUMENTS

| | | | |
|---|---|---|---|
| DE | 1 218 473 | | 6/1966 |
| EP | 0 675 385 | A1 | 10/1995 |
| EP | 1 106 360 | A1 | 6/2001 |
| EP | 1 557 270 | A1 | 7/2005 |
| JP | 59-075205 | | 4/1984 |
| JP | 61-245106 | | 10/1986 |
| JP | 63-235901 | | 9/1988 |
| JP | 63-294503 | | 12/1988 |
| JP | 01-277802 | | 11/1989 |
| JP | 02-173703 | | 7/1990 |
| JP | 02-173704 | | 7/1990 |
| JP | 06-118022 | | 4/1994 |
| JP | 07-198924 | | 8/1995 |
| JP | 08-160219 | | 6/1996 |
| JP | 10-039130 | | 2/1998 |
| JP | 10-073813 | | 3/1998 |
| JP | 2000-272134 | | 10/2000 |
| JP | 2002-277622 | | 9/2002 |
| JP | 2003-303544 | | 10/2003 |
| JP | 2004-001378 | | 1/2004 |
| JP | 2004-077681 | | 3/2004 |
| JP | 2004069494 | | 3/2004 |
| TW | 204078 | | 4/1993 |
| TW | 389168 | | 5/2000 |
| TW | 479917 | | 3/2002 |
| TW | 565690 | | 12/2003 |
| TW | I221121 | | 9/2004 |
| WO | WO 02/14076 | A1 | 2/2002 |
| WO | WO 03/045697 | A1 | 6/2003 |

OTHER PUBLICATIONS

U.S. Appl. No. 12/354,759 (9521-8/D1 filed Jan. 15, 2009.

Tseng et al. "Characterization of Droplet Injector Process of a Microinjector," US 13th. National Congress of Applied Mechanics, Jun. 21-26, 1998 University of Florida.

Tseng et al. "A Microinjection Free of Satellite Drops and Characterization of the Ejected Droplets" University of California, (1998) ASME International Mechanical Eng. Congress and Expositions.

* cited by examiner

METHODS AND SYSTEMS FOR INKJET DROP POSITIONING

CROSS REFERENCE TO RELATED APPLICATIONS

The present application is related to U.S. patent application Ser. No. 11/019,930, filed Dec. 22, 2004 and entitled "METHODS AND APPARATUS FOR ALIGNING PRINT HEADS" which is hereby incorporated by reference herein in its entirety.

The present application is related to U.S. Provisional Patent Application Ser. No. 60/721,741, filed on even date herewith and entitled "METHODS AND APPARATUS FOR INKJET PRINTING COLOR FILTERS FOR DISPLAY PANELS" which is hereby incorporated by reference herein in its entirety.

The present application is related to U.S. patent application Ser. No. 11/123,502, filed May 4, 2005 and entitled "DROPLET VISUALIZATION OF INKJETTING" which is hereby incorporated by reference herein in its entirety.

The present application is related to U.S. patent application Ser. No. 11/061,148, filed on Feb. 18, 2005 and entitled "INKJET DATA GENERATOR" which is hereby incorporated by reference herein in its entirety.

The present application is related to U.S. patent application Ser. No. 11/061,120, filed on Feb. 18, 2005 and entitled "METHODS AND APPARATUS FOR PRECISION CONTROL OF PRINT HEAD ASSEMBLIES" which is hereby incorporated by reference herein in its entirety.

FIELD OF THE INVENTION

The present invention relates generally to inkjet printing systems employed during flat panel display formation, and is more particularly concerned with apparatus and methods for inkjet drop positioning.

BACKGROUND OF THE INVENTION

The flat panel display industry has been attempting to employ inkjet printing to manufacture display devices, and in particular, color filters for flat panel displays. Because the pixel wells into which ink is deposited when printing patterns for color filters may be particularly small, the possibility of printing error is significant. Thus, it is frequently necessary to inspect substrates to ensure that ink has been properly deposited. Therefore, efficient methods and apparatus for inspecting inkjet printed substrates and making adjustments to printing parameters are desirable.

SUMMARY OF THE INVENTION

In certain aspects of the invention, a method of inkjet drop positioning is provided. The method includes imaging a substrate, detecting variations in print parameters of an inkjet printing system based on the imaged substrate, calculating a correction factor based on the imaged substrate and detected variations in print parameters, adjusting at least one print parameter of the inkjet printing system based on the correction factor, and depositing an ink drop to an intended deposition location using the inkjet printing system after adjusting the at least one print parameter.

In certain aspects of the invention, another method of inkjet drop positioning is provided. The method includes detecting variations of a substrate, depositing an ink drop on the substrate using an inkjet printing system, detecting an actual deposition location of the deposited ink drop on the substrate relative to an intended deposition location, calculating a correction factor based on the actual deposition location and the detected variations of the substrate, adjusting at least one print parameter of the inkjet printing system based on the correction factor, and depositing a ink drop to a deposition location after adjusting the at least one print parameter.

In certain aspects of the invention, a system for inkjet drop positioning is provided. The system includes at least one inkjet print nozzle adapted to deposit ink to a substrate, a first imaging system adapted to detect a location of the ink deposited by the inkjet print nozzle on the substrate, a second imaging system adapted to detect variations in print parameters of an inkjet printing system, and a controller adapted to receive a signal transmitted from the first and second imaging systems, compare the location of the ink deposited on the substrate to an intended deposition location, determine a difference between the location of the ink deposited on the substrate and the intended deposition location, and compensate for the difference between the location of the ink deposited on the substrate and the intended deposition location by adjusting at least one print parameter of the inkjet printing system.

In certain aspects of the invention, system for use in inkjet printing is provided. The system includes at least one inkjet print head adapted to deposit ink to a substrate. The system may also include a controller adapted to determine an intended deposition location of the ink on the substrate, control deposition of the ink on the substrate using the at least one inkjet print head, detect a deposited location of the deposited ink on the substrate, compare the deposited location to the intended location, determine a difference between the deposited location and the intended location, and compensate for the difference between the deposited location and the intended location by adjusting a parameter of an inkjet printing system.

Other features and aspects of the present invention will become more fully apparent from the following detailed description, the appended claims and the accompanying drawings.

DETAILED DESCRIPTION

The present invention provides systems and methods for accurate positioning of ink drops on a substrate in an inkjet printing system. According to the present invention, an inspection system capable of detecting and/or correcting positional inaccuracy of ink deposited on a substrate may be provided in an inkjet printing system. Positional inaccuracy of ink deposited on a substrate may be caused by misalignment of inkjet nozzles, inkjet nozzle malfunction and/or clogging, variations in ink drop size and/or deposition velocity, imperfections in a substrate (e.g., buckling, warping, hills, valleys, etc.), mechanical imperfections in the inkjet printing system, or the like. The inspection system of the present invention may include imaging and control systems capable of measuring trajectories and/or actual landing positions of ink drops deposited on a substrate during a test printing operation, comparing the actual landing positions to intended landing positions, and using this information to determine predicted positional inaccuracies. In some embodiments, the inspection system may be capable of providing information to a controller of an inkjet printing system to allow the controller to compensate for these positional inaccuracies by varying such characteristics as ink drop size, ink drop deposition velocity, ink drop deposition timing, inkjet nozzle/print head displacement and/or alignment, inkjet printing system stage movement, and/or other performance characteristics.

In the same or alternative embodiments, a calibration step may be included wherein the inkjet printing system of the present invention may deposit ink onto a substrate and the actual landing positions of ink drops may be compared to intended landing positions to map any positional inaccuracies. Information from the positional inaccuracy map may then be used to make real-time corrections during a print operation and/or adjust parameters of the inkjet printing system to compensate for positional inaccuracies prior to a print operation.

In a particular embodiment, a method of accurately landing ink on a substrate may be provided. The exemplary method may include controlling the firing time of the fire pulse for one or more inkjet print heads. Controlling the firing time of the fire pulse may control ink drop deposition location and may alone or in combination with other adjustments correct for inaccuracies within an inkjet printing system (e.g., clogged nozzles, mis-aligned nozzles, ink drop size variations, ink drop velocity variations, ink drop mass variations, etc.). Controlling the fire pulse may be accomplished by shifting the timing of the clock used to generate the fire pulse, which may accelerate or delay the fire pulse generation. Adjustment of the fire pulse may cause an inkjet print head to accelerate or delay deposition of an ink drop, which may cause the ink drop to be deposited at a particular location on a substrate.

Figure 1A:
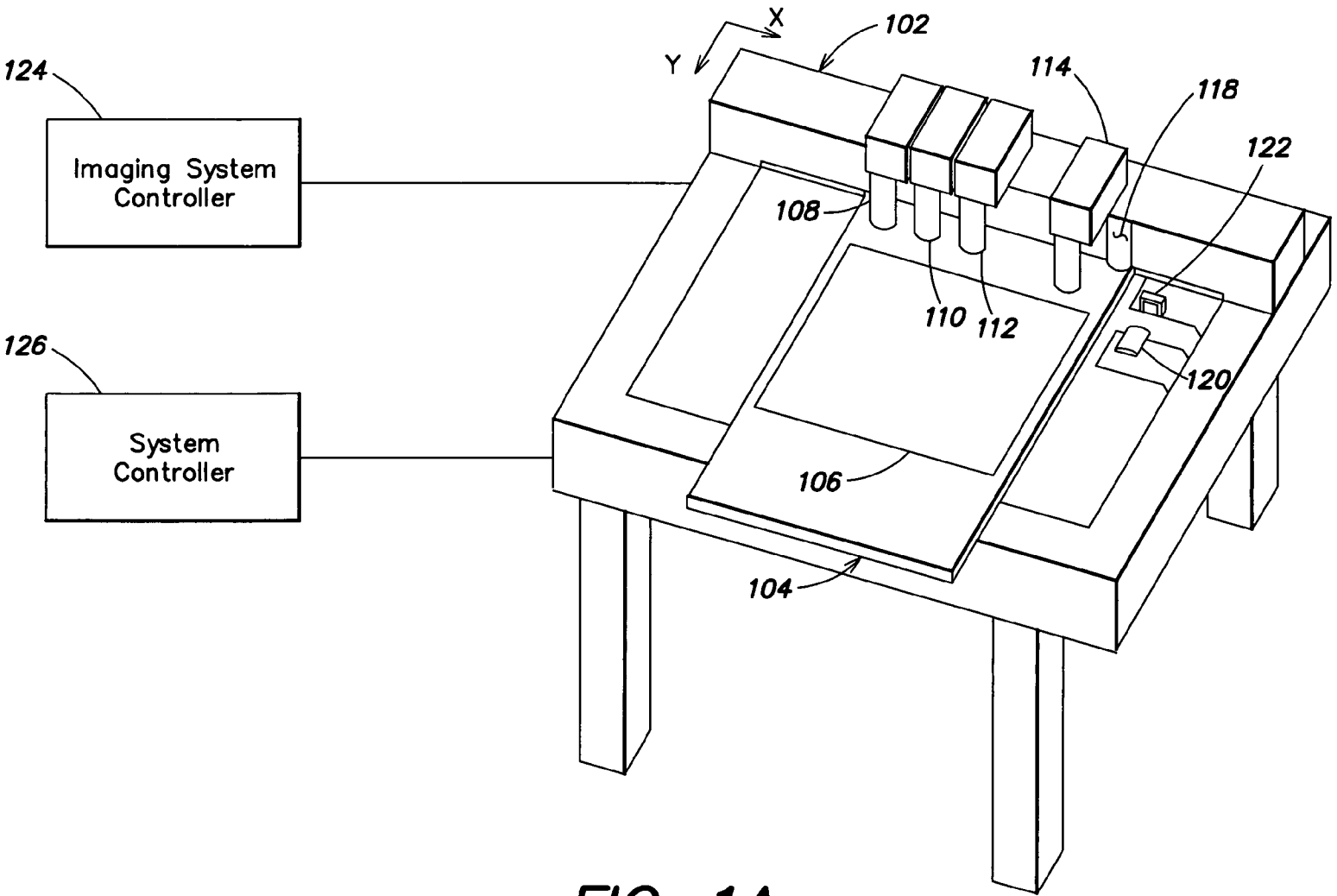
FIG. 1A is a front perspective view of an inkjet printing system according to some aspects of the present invention.
Figure 1B:
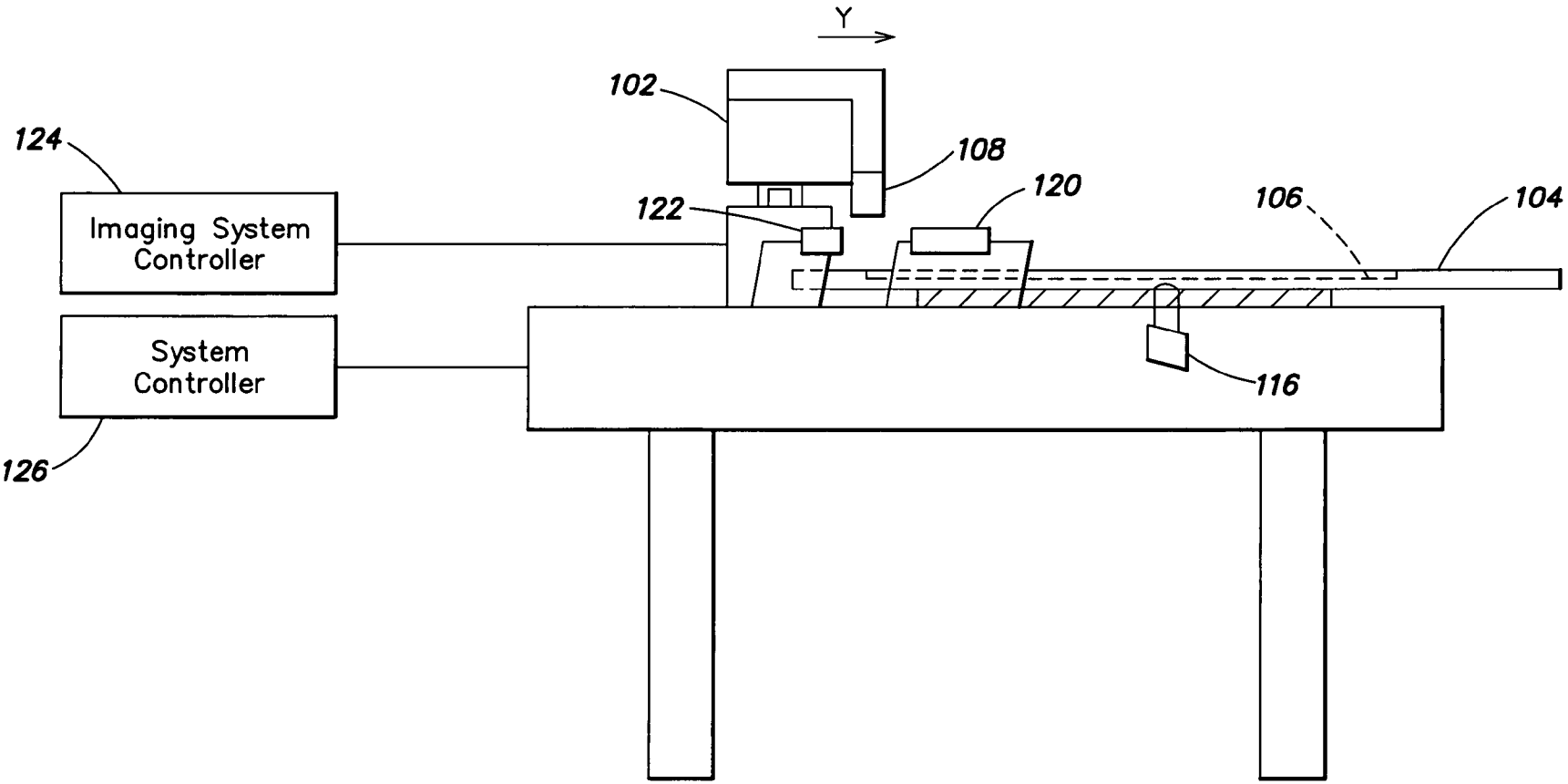
FIG. 1B is a side view of an inkjet printing system according to some aspects the present invention.

FIGS. 1A and 1B illustrate a front perspective view and side view, respectively, of an embodiment of an inkjet printing system of the present invention which is designated generally by reference numeral 100. The inkjet printing system 100 of the present invention, in an exemplary embodiment, may include a print bridge 102. The print bridge 102 may be positioned above and/or coupled to a stage 104. The stage 104 may support a substrate 106.

Supported on print bridge 102 may be print heads 108, 110, 112. Print bridge 102 may also support an imaging system 114. Supported elsewhere (e.g., attached to or positioned beneath stage 104 and/or on print bridge 102 or another print bridge) may be one or more substrate imaging systems 116. Also supported on print bridge 102 may be a range finder 118 (described below).

Supported beneath print heads 108-112 and/or adjacent stage 104 may be a light source 120 for sending light to a visualization device 122. Imaging system 114, substrate imaging system 116, range finder 118, light source 120, and/or visualization device 122 may be coupled (e.g., logically and/or electrically) to one or more imaging system controllers 124. Similarly, print heads 108-112 and print bridge 102 may be coupled (e.g., logically and/or electrically) to a system controller 126.

In the exemplary embodiment of FIGS. 1A and 1B, the print bridge 102 may be supported above the stage 104 in such a manner as to facilitate inkjet printing. The print bridge 102 and/or stage 104 may be movable each independently in both the positive and negative X- and Y-directions as indicated by the X- and Y-direction arrows in FIGS. 1A and 1B and the Y-direction arrow in FIG. 1B. In the same or alternative embodiments print bridge 102 and stage 104 may be rotatable. The print bridge 102 may be capable of supporting and moving any number of print heads 108-112 and/or sensors (e.g., imaging system 114, range finder 118). The substrate 106 may sit atop or, in some embodiments, be coupled to the movable stage 104.

Although three print heads 108-112 are shown on print bridge 102 in FIGS. 1A and 1B, it is important to note that any number of print heads may be mounted on and/or used in connection with the print bridge 102 (e.g., 1, 2, 4, 5, 6, 7, etc. print heads). Print heads 108-112 may each be capable of dispensing a single color of ink or, in some embodiments, may be capable of dispensing multiple colors of ink. Inkjet print heads 108-112 may be movable and/or alignable vertically, horizontally and/or rotationally so as to enable accurate inkjet drop placement. The print bridge 102 may also be movable and/or rotatable to position print heads 108-112 for accurate inkjet printing. In operation, the inkjet print heads 108-112 may dispense ink (e.g., from a nozzle) in drops (see, for example, FIGS. 2 and 3).

Imaging system 114 and substrate imaging system 116 may be directed toward the substrate 106 and may be capable of capturing still and/or moving images of the substrate 106. Exemplary imaging systems for use in an inkjet printing system are described in previously incorporated U.S. patent application Ser. No. 11/019,930. Similarly, imaging system 114 and substrate imaging system 116 may include one or more high resolution digital line scan cameras, CCD-based cameras, and/or any other suitable cameras. Other numbers of imaging systems may be used.

In an exemplary embodiment, the imaging system 114 may be coupled to the print bridge 102 in a position and manner similar to that used for a print head. That is, the imaging system 114 may be capable of similar rotation and movement as the print heads 108-112 and may be moved adjacent the print heads 108-112 or may be spaced apart from them. The imaging system 114 may include a single camera or, in some embodiments, multiple cameras (e.g., 2, 3, etc.) in a cluster. Imaging system 114 may be positioned on either side of the print heads 108-112 or may be positioned interstitially. Imaging system 114 may be angled to capture images of a completed print pass (e.g., to capture images of ink drops on substrate 106) or may be angled in any direction to capture images of various portions of the substrate 106.

In some embodiments, imaging system 114 may be capable of capturing images of the substrate 106 and/or ink drops released from print heads 108-112. Imaging system 114 is preferably capable of capturing images of sufficient quality to discern ink drops of about 2 um to about 100 um in diameter. Accordingly, imaging system 114 may include a telescope zoom lens and may have high resolution (e.g., at least about 1024×768 pixels). The imaging system 114 may also be equipped with motorized zoom and/or focus features.

The substrate imaging system 116 may have similar performance characteristics and capabilities as imaging system 114. Accordingly, the substrate imaging system 116 may be capable of capturing still and/or moving images of the substrate 106. Although depicted in FIG. 1B as positioned beneath the substrate 106, it is understood that substrate imaging system 116 may be positioned in any location that may afford a view of the substrate 106. The substrate imaging system 116 may be capable of detecting (e.g., through imaging) imperfections of the substrate 106 and/or debris on the surface of the substrate 106. In some embodiments, the substrate imaging system 116 may be located on print bridge 102, on another print bridge (not shown), at another location in the inkjet printing system 100, or at a location apart from the inkjet printing system 100.

The range finder 118 may be capable of detecting a range (e.g., distance) from the inkjet print heads 108-112 to the substrate 106. The range finder 118 may also be capable of determining a height (e.g., thickness) of the substrate 106. Range finder 118 may be any suitable sensor capable of performing these and other related functions. Exemplary sensors for use in an inkjet print system are described in previously incorporated application Ser. No. 60/271,741. In this example, a laser sensor may be utilized. The laser sensor may, at a high sampling rate and accuracy, measure the thickness and/or height of the substrate 106 and/or stage 104. An example of a commercially available laser sensor is the LC-series Laser Displacement Meter manufactured by Keyence Corp. of Osaka, Japan. Another example of a commercially available sensor is the Omron ZS series manufactured by Omron Electronics Pte Ltd of Singapore. In an alternative embodiment, the range finder 118 may be another sensor, such as an ultrasonic distance sensor.

The light source 120 may be capable of transmitting a light beam to visualization device 122. In an exemplary embodiment, the light source 120 may transmit a nanosecond pulsed laser to illuminate continuously generated ink drops from inkjet print heads 108-112. Laser light may be chosen as the preferred light source for its faster and more accurate on/off control and finite directionality. Fast and accurate on/off control of the light source 120 may be important in this application and the finite directionality of the laser beams makes the images of the dispensed ink drops more clear. A relatively high power pulsed laser may be required to ensure sufficient image intensity to be achieved within a short illumination pulse. In some embodiments, the power of the laser light may be between about 0.001 mW and 20 mW. For an ink drop traveling at a speed of about 8 m/s to be captured by imaging system 114 with a field of view between about 0.1 mm and 5 mm, the light source 120 needs to be pulsed at less than about a 200 microseconds time interval. Other laser light powers, pulse widths and/or duty cycles, and/or wavelengths may be used.

In an exemplary embodiment, two images of the ink drop may be taken in one image frame. The light source 120 may be fired with a controlled interval such that the ink drop has not traveled outside the field of view. The distance between the two images may be used to measure the distance the ink drop has traveled. This information may be used to calculate an ink drop velocity.

In one embodiment, the visualization device 122 may be a charge coupled device (CCD) camera. Since the ink drops dispensed from inkjet print heads 108-112 may be quite small (e.g., about 2 um to about 100 um in diameter), a telescope zoom lens may be required. The visualization device 122 may preferably have high resolution (e.g., at least 1024×768 pixels) to increase the resolution of droplet detection. The visualization device 122 may also be equipped with a motorized zoom and focus device (not shown). Other camera types and/or resolutions may also be used. In some embodiments the position, including height and the mounted angle, of the visualization device 122 can be adjusted to align with the trajectories of the dispensed ink drops. The field of view of the visualization device 122 may be, for example, between about 0.1 mm and about 5 mm, and the field of depth of the visualization device 122 may be, for example, between about 0.05 mm and about 5 mm to take images of ink drops dispensed from the inkjet print heads 108-112, whose sizes may be between about 2 um and about 100 um in diameter. Other fields of view and/or depths may be used. Exemplary light sources 120 and visualizations devices 122 for use in the inkjet print system of the present invention are described in previously incorporated U.S. patent application Ser. No. 11/123,502. Light source 120 and visualizations device 122 may be used to measure ink drop size, ink drop velocity, and/or other attributes of ink drops.

Imaging system controller 124 may be capable of processing image information received from the imaging system 114, the substrate imaging system 116, the range finder 118, the light source 120, and/or visualization device 122. The imaging system controller 124 may also be capable of transmitting command and control information to these same devices. Imaging system controller 124 may be any suitable computer or computer system, including, but not limited to, a mainframe computer, a minicomputer, a network computer, a personal computer, and/or any suitable processing device, component, or system. Likewise, the imaging system controller 124 may comprise a dedicated hardware circuit or any suitable combination of hardware and software.

Similarly, the print bridge 102, stage 104, and/or inkjet print heads 108-112 may be coupled to system controller 126. System controller 126 may be adapted to control motion of the print bridge 102, the stage 104, and/or the inkjet print heads 108-112 in inkjet printing operations. System controller 126 may also control firing pulse signals for inkjet print heads 108-112. In at least one embodiment, the imaging system controller 124 and the system controller 126 may comprise a single controller or multiple controllers.

Figure 2:
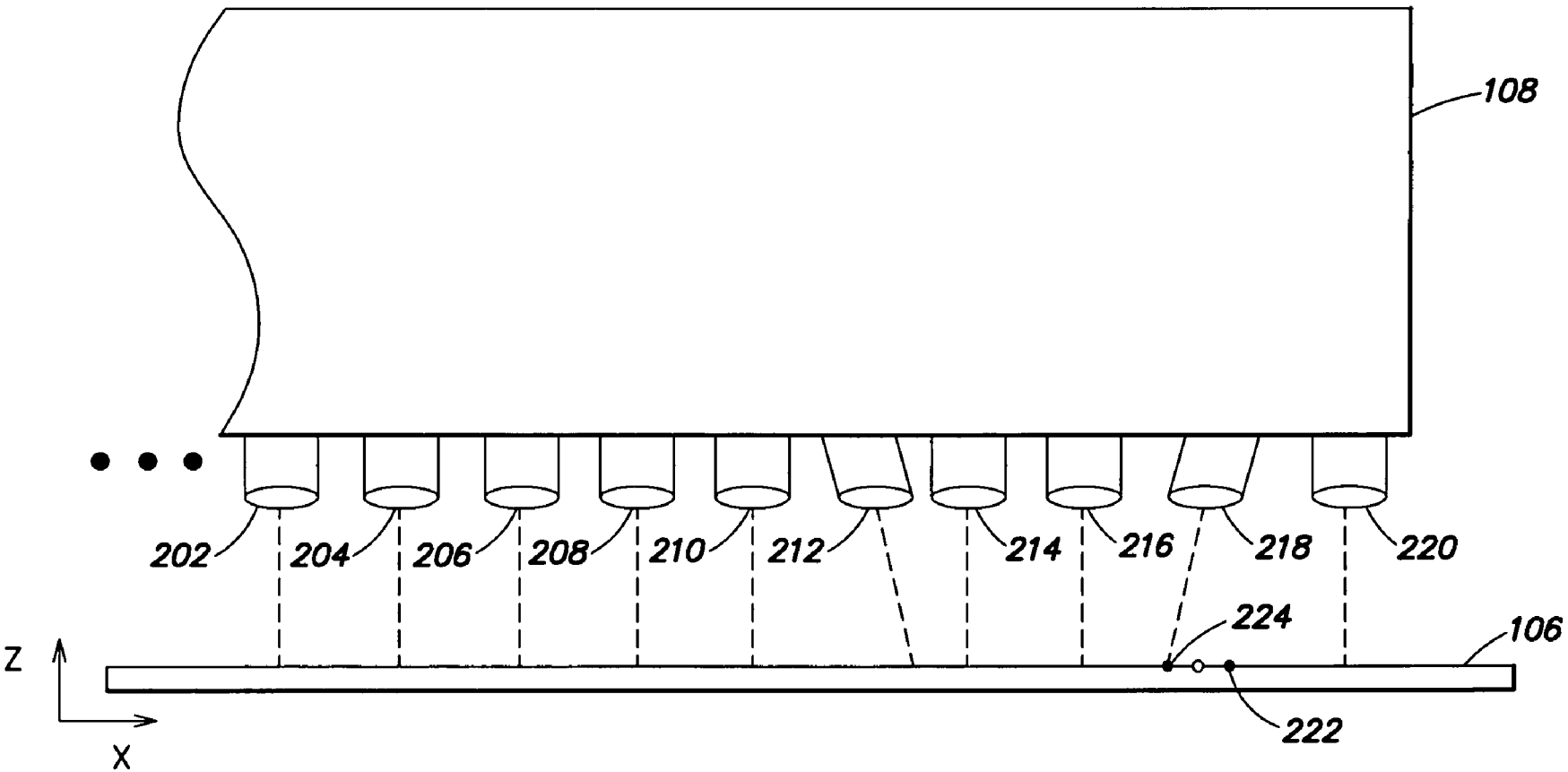
FIG. 2 is a close-up schematic view of an inkjet print head for use in some aspects of the present invention.

FIG. 2 depicts a close-up schematic view of an inkjet print head 108 for use with the present invention. Inkjet print head 108 may have any number of nozzles 202-220 for jetting ink coupled thereto. Ink drops may be deposited from nozzles 202-220 onto the substrate 106.

The exemplary print head 108 of FIGS. 1A, 1B, and 2 may have any number of nozzles 202-220 coupled to it. In an exemplary embodiment, the print head 108 may have one or more rows of nozzles 202-220, each row having about 128 nozzles. Ten nozzles 202-220 are shown in FIG. 2 for simplicity. In at least one embodiment, nozzles 202-220 are aligned vertically so as to jet ink drops (indicated by dotted lines in FIG. 2) onto substrate 106 at an intended deposition location 222, which may differ from an actual deposition location 224.

For various reasons one or more of nozzles 202-220 may become mis-aligned. For example, a nozzle may be pushed out of place by another component or during a cleaning operation or a nozzle may be askew due to manufacturing defect. Similarly, partial clogging of a nozzle 202-220 may cause ink drops to be dispensed as if a nozzle 202-220 were mis-aligned. FIG. 2 depicts nozzles 212 and 218 as mis-aligned. Mis-alignment of nozzles 212 and 218 may result in improperly placed ink drops. Ink drops from nozzle 218 may, for example, attempt to jet ink drops to an intended deposition location 222, which may differ from an actual deposition location 224.

In an exemplary embodiment, ink drops may be required to be deposited to an intended deposition location 222 with an accuracy of about +/−10 microns or less in all directions.

Additionally, it may be advantageous to precisely and efficiently print small patterns of different geometric shapes, thus necessitating depositing ink drops of various sizes. Ink drops of different sizes may require different ink drop velocities. Depositing ink drops of different sizes at different velocities may result in ink drops being deposited inaccurately (e.g., to an actual deposition location 224 that differs from the intended deposition location 222)—similar to mis-aligned nozzles 212 and 218.

Figure 3:
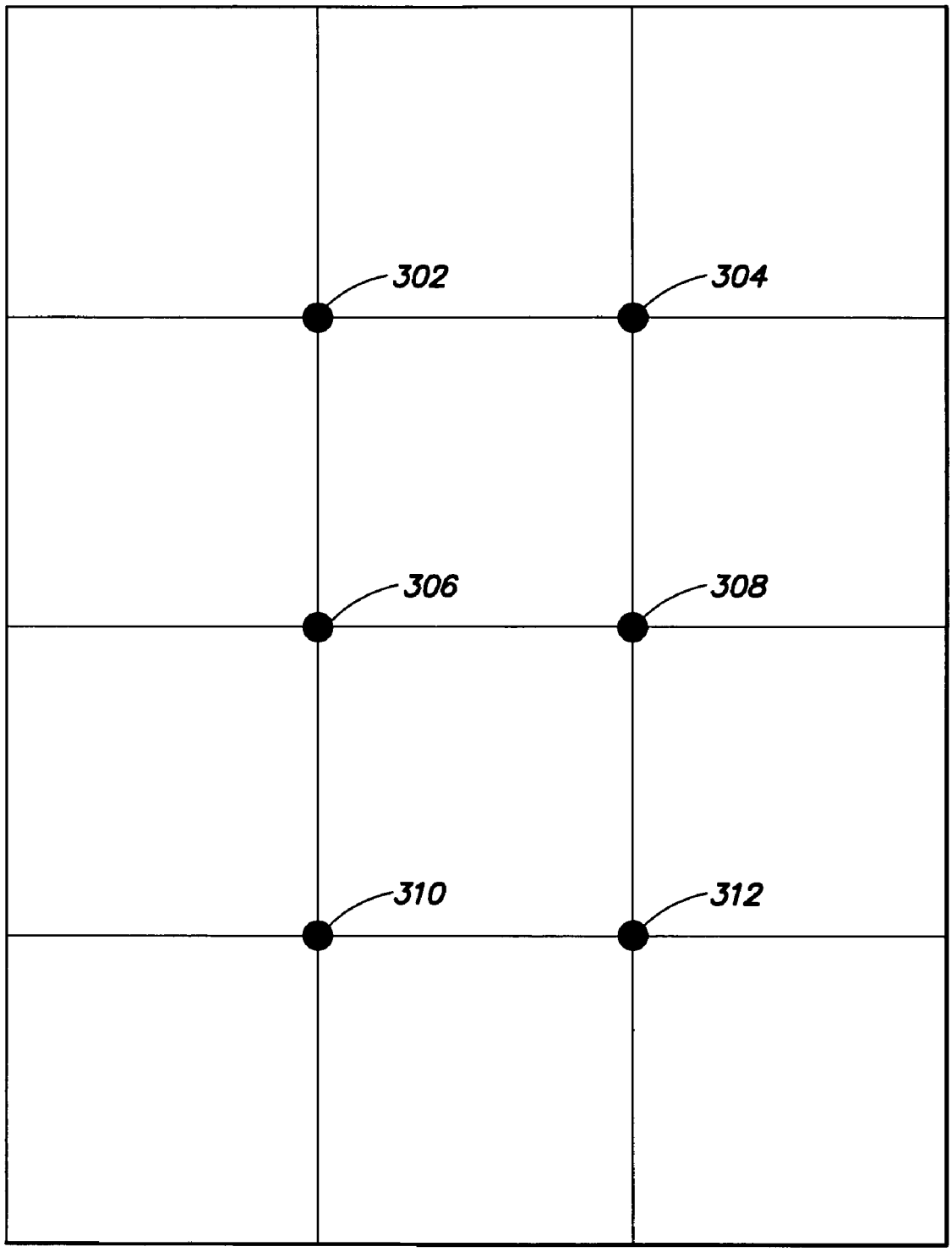
FIG. 3 is a top view of a calibration substrate according to some aspects of the present invention.

FIG. 3 depicts a top view of a calibration substrate 300 for use with the present invention. Calibration substrate 300 may have any number of calibration points 302-312.

Calibration substrate 300 may be a substrate for use in a calibration step with the inkjet printing system 100. In an exemplary embodiment, calibration substrate 300 may be a substrate with no defects or known defects and marked with calibration points 302-312. The calibration substrate 300 may be reusable in a calibration process. In an alternative embodiment, the calibration substrate may be a new or used substrate that may be analyzed following a calibration print step to determine proper ink drop placement.

In an exemplary embodiment, the calibration points 302-312 may be marks on the calibration substrate 300 indicating an intended deposition location. In an alternative embodiment, calibration points may be previously determined pixel wells on the surface of the calibration substrate 300. In another embodiment, the calibration points 302-312 may be determined after a test print. That is, they may not be predetermined and may be determined based on which nozzles of an inkjet print head are used in a test print.

Calibration points 302-312 may be arranged in any suitable pattern. In the exemplary embodiment of FIG. 3, the calibration points 302-312 may be arranged in a grid, equidistant from each other. In alternative embodiments, calibration points 302-312 may be arranged randomly. In still other embodiments, calibration points 302-312 may be arranged in small groups (e.g., 2 or more closely spaced calibration points). Any suitable number of calibration points may be used.

Figure 4:
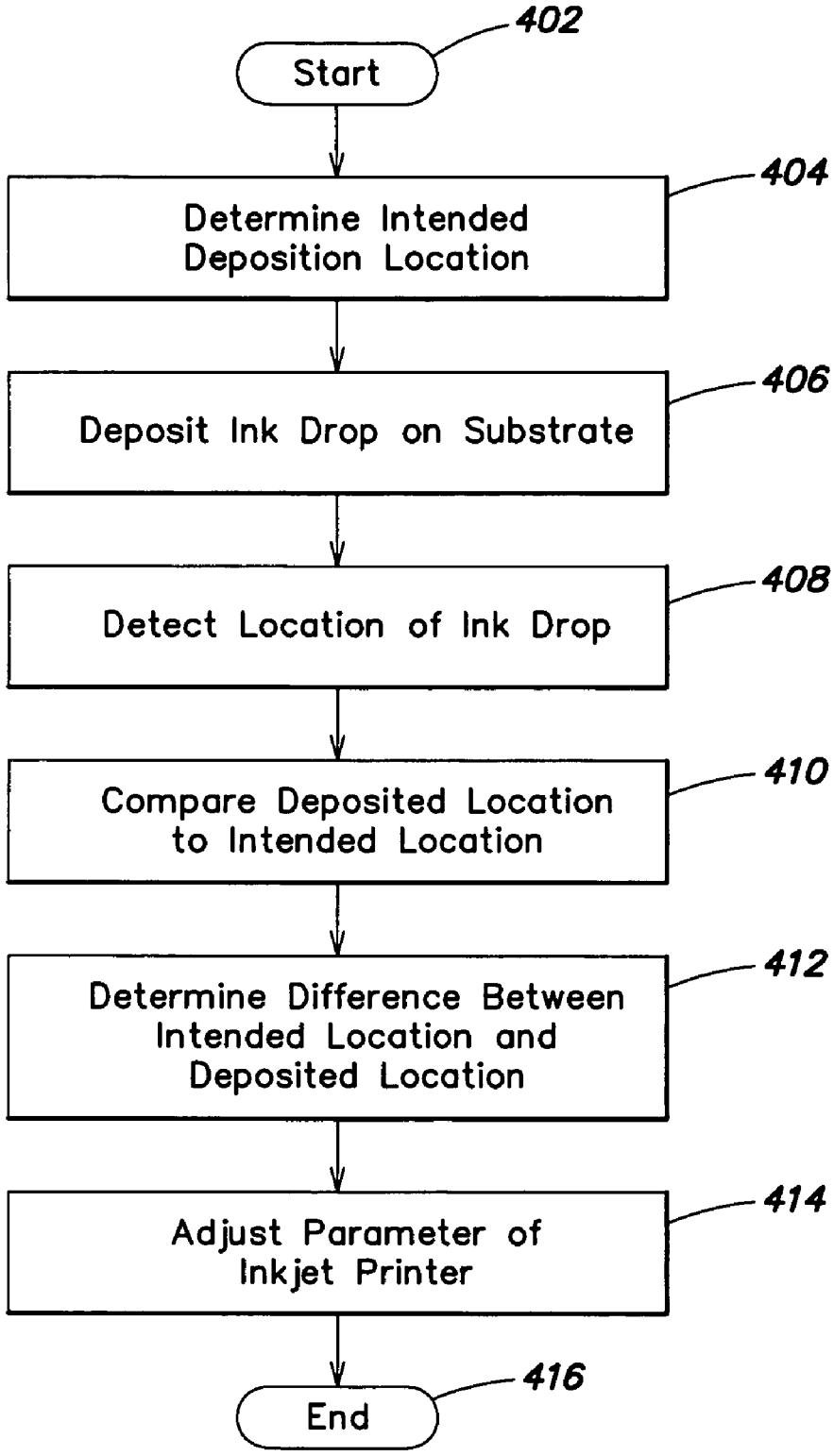
FIG. 4 is a flowchart illustrating a first exemplary method of inkjet drop positioning according to some embodiments of the present invention.

FIG. 4 depicts a first exemplary method 400 of inkjet drop positioning according to the present invention. The exemplary method begins at step 402.

In step 404, an intended deposition location of an ink drop on a substrate is determined. The intended deposition location may be a calibration point 302-312 on a calibration substrate 300. In this embodiment, the calibration point 302-312 may be known prior to inkjet printing.

In an alternative embodiment, the intended deposition location may be the intended deposition location 222 on the substrate 106. The intended deposition location 222 may be based on any appropriate criteria; for example, based on the pixel wells (not shown) of the substrate 106. In this embodiment, the substrate 106 may be partially printed (e.g., to the actual deposition location 224).

In step 406, one or more ink drops may be deposited on the substrate. One or more ink drops may, for example, be deposited by inkjet print head 108 (and/or print heads 110-112) onto substrate 106. In an alternative embodiment, one or more of inkjet print heads 108-112 may deposit one or more ink drops onto calibration substrate 300.

In step 408, a deposited location of one or more deposited ink drops may be detected on the substrate. In an exemplary embodiment, the actual deposition location 224 of the ink drop on the substrate 106 may be detected by imaging system 114. Imaging system 116 may capture an image of the substrate 106, including the intended deposition location 222 and the actual deposition location 224. Additionally or alternatively, the imaging system 114 may capture positional information (e.g., location in a two or three dimensional space) about the intended deposition location 222 and the actual deposition location 224. In the same or alternative embodiments, substrate imaging system 116 may capture an image of the substrate 106, including the intended deposition location 222 and the actual deposition location 224. Information (e.g., captured images and/or positional information) collected by the imaging system 114 and/or the substrate imaging system 116 may be relayed to the imaging system controller 124 and/or the system controller 126.

In another embodiment, the substrate 106 may be removed from the inkjet printing system 100 and the substrate 106 may be otherwise imaged or examined to detect the deposited location of the ink drop or drops.

In step 410, the deposited location of the deposited ink drop may be compared to the intended location. In an exemplary embodiment, imaging system controller 124 and/or system controller 126 may use positional information and/or images collected from the imaging system 114 and/or the substrate imaging system 116 in conjunction with known positional information about the intended deposition location 222 to compare the intended deposition location 222 with the actual deposition location 224.

In step 412, a difference between the deposited location and the intended location may be determined. In an exemplary embodiment, after step 410, the imaging system controller 124 and/or the system controller 126 may utilize algorithms to determine differences between the intended deposition location 222 and the actual deposition location 224.

Determining the difference between the intended deposition location 222 and the actual deposition location 224 may include mapping one or more intended deposition locations 222, overlaying a map of one or more corresponding actual deposition locations 224, and logging these results into a file (e.g., plotting into or creating a two or three dimensional map). In another embodiment, determining the difference between the intended deposition location 222 and the actual deposition location 224 may include creating or using a look-up table of correction factors or offsets in jet timing for inkjet print heads 108-112 (e.g., pulse width and/or amplitude for nozzles 202-220). Other methods for determining a difference between intended and actual deposition locations may be employed.

In step 414, the difference between the deposited location and the intended location may be compensated for by adjusting one or more parameters of the inkjet printing system. In an exemplary embodiment, parameters to be adjusted may include ink drop mass, ink drop deposition velocity, ink drop deposition timing, inkjet nozzle/print head displacement and/or alignment, inkjet printing system stage movement, and/or the like.

Parameters may be adjusted, for example, to alter the trajectory of the deposited ink drops based on a correction factor from a look-up table. In another embodiment, the intended deposition location 222 and the actual deposition location 224 may be used to calculate changes to one or more parameters of the inkjet printing system 100.

For example, using coordinates of the actual deposition location 224, a new time of travel, ink drop initial velocity, or angle of fire may be calculated by using the equations:

$$x = v_0 t \cos\theta$$

$$z = v_0 t \sin\theta - \frac{gt^2}{2}$$

wherein:

X- and Z-directions are indicated in FIG. 2;

$v_0$ the initial velocity of an ink drop;

t is the time of travel of an ink drop;

θ is the initial angle of an ink drop's trajectory made with respect to the X-axis; and g is the acceleration due to gravity.

With the X-component of the trajectory known from the actual landing position 224, the Z-component determined by the range finder 118, the initial velocity determined using light source 120 and visualization device 122, and the initial angle calculated using the intended deposition location 222 and the actual deposition location 224, the time of travel may be calculated. It is noted and would be recognized by one of skill in the art that these are simplified equations. Specifically, the equations neglect the resistance of air and treat the ink drop as a point mass which travels in a two dimensional plane (e.g., the X-Z plane as indicated in FIG. 2). Imaging system controller 124 and/or system controller 126 may use these or other appropriate equations to calculate parameters of the inkjet printing system to be changed.

In the same or alternative embodiments, known or estimated values for print parameters may be used without measurement. Any combination of known and/or calculated inkjet printing system parameters may be used to calculate adjustments to the same or other parameters. For example, adjustments to the pulse width and/or amplitude of the nozzles 202-220 may be adjusted independent of or without a thickness of the substrate 106.

The mass and velocity of ink drops may be a function of a firing pulse width and amplitude for nozzles 202-220. Details of apparatus and methods for adjusting pulse width and amplitude of print head nozzles are described in previously incorporated U.S. patent application Ser. No. 11/061,148 and previously incorporated U.S. patent application Ser. No. 11/061,120. Based on information received from the imaging system controller 124 and/or system controller 126 (e.g., a correction factor from a look-up table), firing pulse widths and/or amplitudes for nozzles 202-220 may be adjusted, thus adjusting the mass and/or velocity of ink drops deposited by the printing system. The ink drops with the adjusted mass and/or velocity may then be deposited to substrate 106.

Similarly, fire pulse width and/or amplitude may be adjusted to change the timing of ink drop deposition based on information from the imaging system controller 124 (and/or system controller 126). In an exemplary embodiment, if an nozzle 218 is positioned as shown in FIG. 2 and the substrate 106 is traveling in the +X direction, the nozzle 218 may be timed to fire earlier (according to information received from the imaging system controller 124 and/or system controller 126) to cause an ink drop output by the nozzle 218 to land at the intended deposition location 222.

The angle or location of inkjet print heads 108-112 and/or nozzles 202-220 may be adjusted to compensate for discrepancies between the actual deposition location 224 and the intended deposition location 222. Adjustment of the angle or location of inkjet print heads 108-112 and/or nozzles 202-220 may serve to adjust a firing trajectory of the ink drop. In an exemplary embodiment, the imaging system controller 124 and/or the system controller 126 may send control signals to inkjet print heads 108-112. The control signals may indicate an amount of movement and/or rotation to cause the inkjet print heads 108-112 to deposit ink drops at the intended deposition location 222. In the same or alternative embodiments, control signals may be sent to nozzles 202-220 for the same purpose. In another exemplary embodiment, imaging system controller 124 and/or system controller 126 may relay control signaling to inkjet print heads 108-112, print bridge 102, stage 104, or any other component of inkjet printing system 100 indicating a degree or amount of movement and/or adjustment in motion speed and/or direction.

In operation, if there is no detected actual deposition position 224, an alert condition may be generated by the imaging system controller 124 and/or system controller 126. The alert condition may indicate a clogged nozzle 202-220 or other similar conditions. The alert condition may cause inkjet printing to be halted (e.g., with a signal from system controller 126). In the same or alternative embodiments, the alert condition may cause an indication of the undetected actual deposition location 224 to be relayed to an external control station (not shown).

The method ends at step 416.

Figure 5:
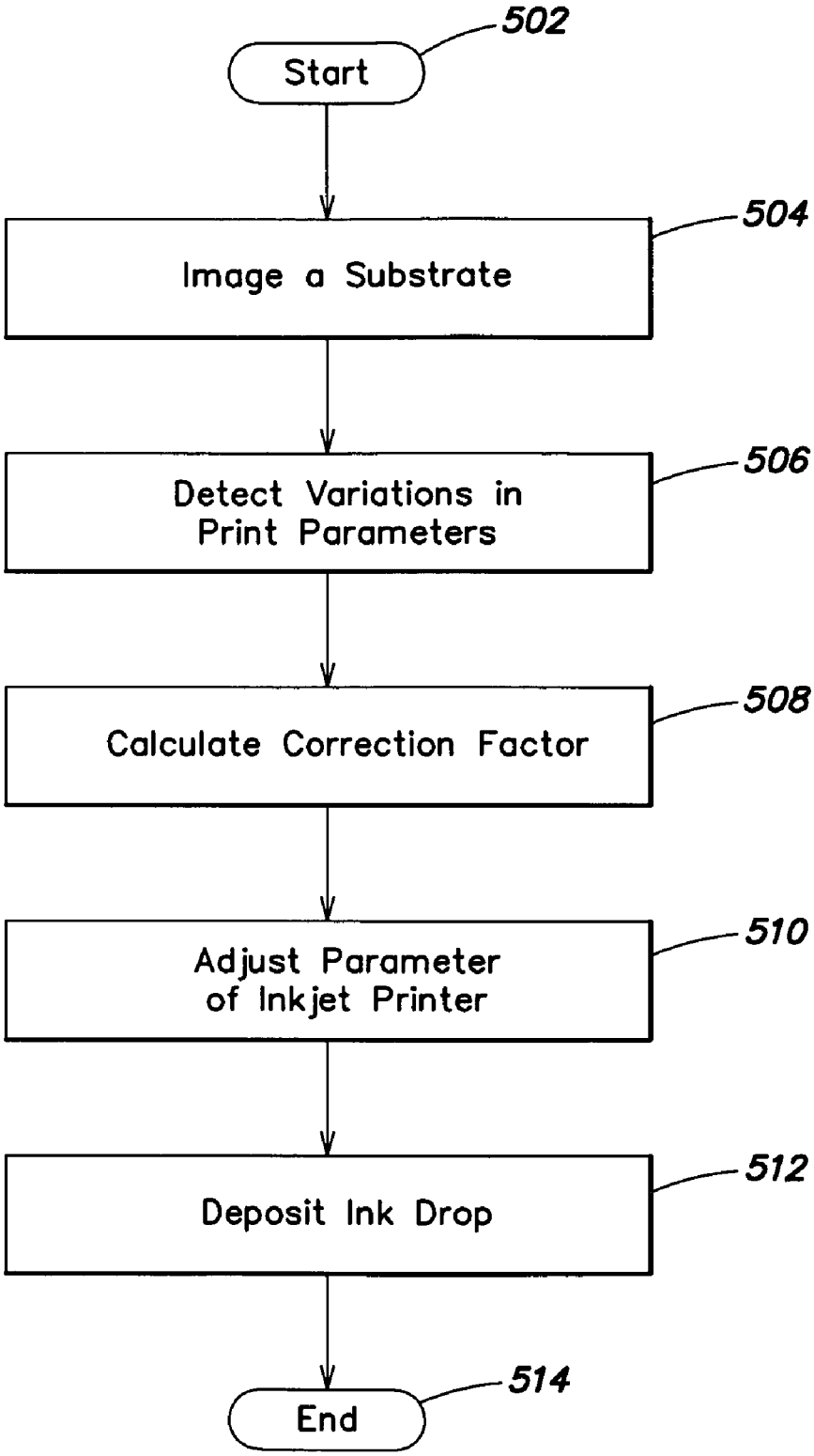
FIG. 5 is a flowchart illustrating a second exemplary method of inkjet drop positioning according to some embodiments of the present invention.

Turning to FIG. 5, a flowchart depicting a second exemplary method 500 of inkjet printing according to the present invention is illustrated. The exemplary method begins at step 502.

In step 504, the substrate 106 is imaged. In an exemplary embodiment, substrate imaging system 116 may capture an image and/or positional information of the substrate 106. Images and/or positional information of the substrate 106 may be converted into a two or three dimensional map of the substrate or may be otherwise rendered (e.g., converted to a chart of high and low points for use in a look-up table). Imaging the substrate 106 may include detecting imperfections in the substrate 106 (e.g., buckling, warping, hills, valleys, etc.). In an alternative embodiment, the substrate 106 may be imaged outside of the inkjet printing system 100 and/or may have known variations and/or imperfections that may be relayed to the imaging system controller 124 and/or the system controller 126.

In step 506, variations in print parameters (e.g., nozzle mis-alignment, ink drop velocity, etc.) of the inkjet printing system 100 may be detected. In an exemplary embodiment, detecting variations in print parameters may include a calibration step. During the calibration step, a test print may be performed as described above. Information from the test print may be used to determine and/or record variations in print parameters. In an alternative embodiment, an outside system and/or method may be used to detect variations in print parameters.

In step 508, a correction factor based on the imaged substrate 106 and any detected variations in print parameters may be calculated. Imaging system controller 124 and/or system controller 126 may utilize substrate 106 information obtained in step 504 and print parameter variations determined in step 506 to calculate changes to print parameters required to land an ink drop at the intended deposition location 222 (e.g., using a look-up table, positional algorithms, constructing a correction map, etc.).

The correction factor may be capable of altering a print parameter that was not detected as having a variation in step 506. For example, if nozzle 218 is determined to be misaligned (as shown in FIG. 2) in step 506, the correction factor may include a factor for increasing the velocity of an ink drop jetted from nozzle 218, such that the ink drop is landed at intended deposition location 222. This correction may be applied instead of or in addition to adjustment of the nozzle 218. Any other appropriate correction factor may be used. Multiple correction factors may be calculated and utilized to adjust the landing position of an ink drop.

In step 510, at least one print parameter of the inkjet printing system 100 may be adjusted based on the correction factor calculated in step 508. Adjusting a print parameter is discussed above with respect to step 414 of method 400.

In step 512 an ink drop may be deposited to an intended deposition location using the inkjet printing system 100 after adjusting at least one print parameter in step 510. In an exemplary embodiment, mis-aligned nozzle 218 of inkjet print head 108 may deposit (e.g., jet) an ink drop onto substrate 106. The ink drop may be deposited to intended deposition location 222 as a result of the adjustment to a print parameter (e.g. increasing the initial ink drop velocity) and based on the correction factor determined in step 508.

The method ends at step 514.

Figure 6:
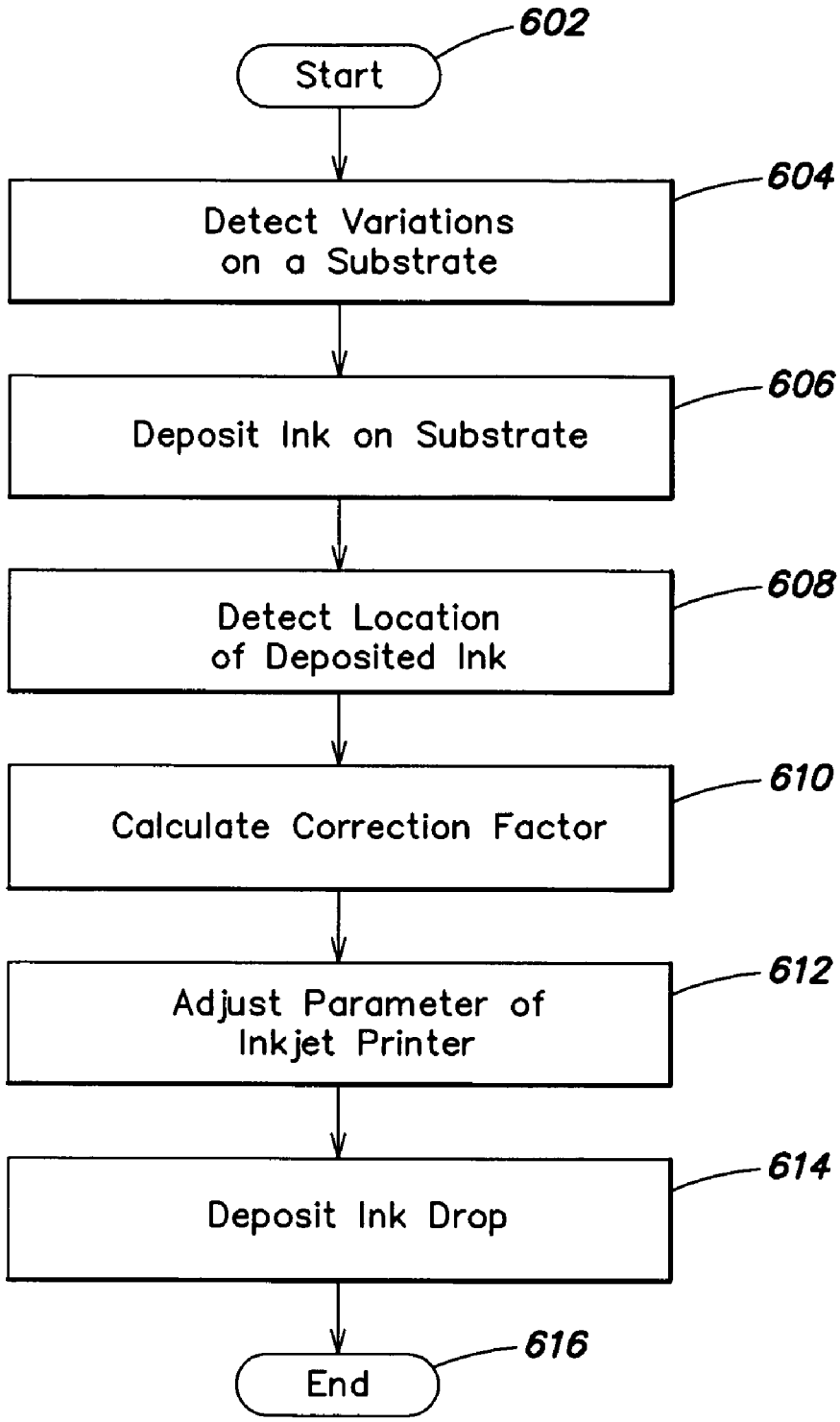
FIG. 6 is a flowchart illustrating a third exemplary method of inkjet drop positioning according to some embodiments of the present invention.

FIG. 6 depicts a flowchart of an exemplary method of inkjet drop positioning according to some embodiments of the present invention. The method begins at step 602.

In step 604, variations of a substrate may be detected. Methods and apparatus for detecting variations of a substrate are discussed above with respect to step 504 (imaging a substrate) of method 500.

In step 606, ink is deposited on the substrate using the inkjet printing system 100. In an exemplary embodiment, an ink drop may be deposited from nozzle 218 of inkjet print head 108 onto substrate 106.

In step 608, the actual deposition location of the deposited ink drop may be detected relative to the intended deposition location. Exemplary methods and apparatus for detecting the intended deposition location and the actual deposition location are discussed above with respect to steps 404 (determining an intended deposition location), 504 (imaging a substrate), and 408 (detecting an actual deposition location).

In step 610, a correction factor based on the actual deposition location and the intended deposition location may be calculated. An example of a method for calculating a correction factor is described herein above with respect to step 508 (calculating a correction factor) of method 500.

In step 612, at least one print parameter of the inkjet printing system is adjusted based on the correction factor determined in step 610. Exemplary methods for adjusting print parameters are discussed in step 414 (adjusting a print parameter) of method 400.

In step 614, an ink drop is deposited to an intended deposition location after adjusting at least one print parameter in step 612. In an exemplary embodiment, mis-aligned nozzle 218 of inkjet print head 108 may deposit (e.g., jet) an ink drop onto substrate 106. The ink drop may be deposited to intended deposition location 222 as a result of the adjustment to a print parameter (e.g. increasing the initial ink drop velocity) and based on the correction factor determined in step 610.

The method ends at step 616.

The foregoing description discloses only exemplary embodiments of the invention; modifications of the above disclosed methods and apparatus which fall within the scope of the invention will be readily apparent to those of ordinary skill in the art. For instance, although above example methods are described with reference to adjusting initial velocity of an ink drop in steps 512 and 614 of methods 500 and 600, respectively, one of ordinary skill in the art would understand that these methods may be applied to adjust any print parameter (e.g., ink drop mass, inkjet print head 108-112 location, stage 104 speed, etc.). Further, the present invention may also be applied to spacer formation, polarizer coating, and nanoparticle circuit forming.

Accordingly, while the present invention has been disclosed in connection with specific embodiments thereof, it should be understood that other embodiments may fall within the spirit and scope of the invention, as defined by the following claims.

What is claimed is:

1. A method of inkjet printing comprising:

imaging a substrate;

detecting variations in print parameters of an inkjet printing system;

calculating a correction factor based on the imaged substrate and detected variations in print parameters;

adjusting at least one print parameter of the inkjet printing system based on the correction factor;

determining an intended deposition location on the substrate; and depositing an ink drop to the intended deposition location using the inkjet printing system after adjusting the at least one print parameter.

2. The method of claim 1 wherein imaging the substrate comprises constructing a multi-dimensional map of the substrate.

3. The method of claim 1 wherein imaging the substrate occurs before the substrate enters the inkjet printing system.

4. The method of claim 1 wherein adjusting at least one parameter of the inkjet printing system comprises adjusting a velocity of ink drops dispensed by the inkjet printing system.

5. The method of claim 1 wherein adjusting at least one parameter of the inkjet printing system comprises adjusting a mass of ink drops dispensed by the inkjet printing system.

6. The method of claim 1 wherein adjusting at least one parameter of the inkjet printing system comprises adjusting a trajectory of ink drops dispensed by the inkjet printing system.

7. The method of claim 1 wherein adjusting at least one parameter of the inkjet printing system comprises adjusting a firing pulse timing of the ink drop.

8. The method of claim 1 wherein calculating a correction factor based on the imaged substrate and detected variations in print parameters and adjusting at least one print parameter of the inkjet printing system comprises adjusting the timing of an inkjet print head independent of a thickness of the substrate.

9. A method of inkjet printing comprising:

imaging a substrate, wherein imaging the substrate comprises constructing a multi-dimensional map of the substrate;

detecting variations in print parameters of an inkjet printing system;

calculating a correction factor based on the imaged substrate and detected variations in print parameters;

adjusting at least one print parameter of the inkjet printing system based on the correction factor;

determining an intended deposition location; and depositing an ink drop to the intended deposition location using the inkjet printing system after adjusting the at least one print parameter.

10. The method of claim 9 wherein imaging the substrate occurs before the substrate enters the inkjet printing system.

11. The method of claim 9 wherein adjusting at least one parameter of the inkjet printing system comprises adjusting a mass of ink drops dispensed by the inkjet printing system.

12. The method of claim 9 wherein calculating a correction factor based on the imaged substrate and detected variations in print parameters and adjusting at least one print parameter of the inkjet printing system comprises adjusting the timing of an inkjet print head independent of a thickness of the substrate.

* * * * *

UNITED STATES PATENT AND TRADEMARK OFFICE

CERTIFICATE OF CORRECTION

PATENT NO. : 7,611,217 B2
APPLICATION NO. : 11/238636
DATED : November 3, 2009
INVENTOR(S) : Shamoun et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 874 days.

Signed and Sealed this

Twelfth Day of October, 2010

David J. Kappos

David J. Kappos
*Director of the United States Patent and Trademark Office*